US008970354B2

(12) United States Patent
Lewis

(10) Patent No.: US 8,970,354 B2
(45) **Date of Patent: *Mar. 3, 2015**

(54) ELECTRONIC GUIDES, INCIDENT RESPONSE METHODS, INCIDENT RESPONSE SYSTEMS, AND INCIDENT MONITORING METHODS

(76) Inventor: Timothy John Lewis, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/557,131

(22) Filed: Jul. 24, 2012

(65) Prior Publication Data

US 2012/0286932 A1 Nov. 15, 2012

Related U.S. Application Data

(63) Continuation of application No. 12/415,701, filed on Mar. 31, 2009, now Pat. No. 8,228,176.

(51) Int. Cl.

| | |
|---|---|
| ***G08B 5/00*** | (2006.01) |
| ***H05B 39/00*** | (2006.01) |
| ***H05B 41/00*** | (2006.01) |
| ***G08B 7/06*** | (2006.01) |

(52) U.S. Cl.

CPC ..... *G08B 7/066* (2013.01)
USPC ..... 340/332; 340/815.4; 340/577; 340/628

(58) Field of Classification Search

USPC ..... 340/332
See application file for complete search history.

(56) References Cited

U.S. PATENT DOCUMENTS

| | | | | |
|---|---|---|---|---|
| 4,029,994 | A * | 6/1977 | Iwans | 315/323 |
| 5,572,183 | A * | 11/1996 | Sweeney | 340/332 |
| 6,824,295 | B1 | 11/2004 | Grondal | |
| 6,848,798 | B1 | 2/2005 | Logan et al. | |
| 6,873,256 | B2 | 3/2005 | Lemelson et al. | |
| 7,026,947 | B2 | 4/2006 | Faltesek et al. | |
| 7,114,840 | B2 | 10/2006 | Hamriek | |
| 8,228,176 | B2 * | 7/2012 | Lewis | 340/332 |

(Continued)

FOREIGN PATENT DOCUMENTS

| | | |
|---|---|---|
| JP | 4175997 | 6/1992 |
| JP | 7234649 | 9/1995 |

(Continued)

*Primary Examiner* — Travis Hunnings
(74) *Attorney, Agent, or Firm* — Wells St. John P.S.

(57) ABSTRACT

Incident response methods include receiving notification that an incident has occurred, determining a source of the notification, the source being near the incident, and establishing at least one guided path configured to direct a first person, a first animal, or a first movable device positioned near the source away from the incident and/or to direct a second person, a second animal, or a second movable device toward the incident. Electronic guides include an indicator, and processing circuitry configured to receive a request to configure the indicator from an inactive state to an active state in which the indicator encourages a first person positioned near a first side of the electronic guide to move toward the electronic guide and encourages a second person positioned near a second side of the electronic guide to move away from the electronic guide and configure the indicator according to the request.

27 Claims, 11 Drawing Sheets

(56) References Cited

U.S. PATENT DOCUMENTS

| | | | | |
|---|---|---|---|---|
| 2002/0057204 | A1 | 5/2002 | Bligh | |
| 2003/0214390 | A1 | 11/2003 | Hollister et al. | |
| 2005/0128070 | A1 * | 6/2005 | Faltesek et al. | 340/524 |
| 2007/0069882 | A1 | 3/2007 | Mahajan | |
| 2007/0096663 | A1 | 5/2007 | Wong et al. | |
| 2007/0103329 | A1 | 5/2007 | Lin | |
| 2008/0224849 | A1 | 9/2008 | Sirhan | |
| 2009/0066522 | A1 | 3/2009 | Lee et al. | |

FOREIGN PATENT DOCUMENTS

| | | | | |
|---|---|---|---|---|
| KR | 10-2006-0103727 | | | 10/2006 |
| KR | 2006103727 | A | * | 10/2006 |
| KR | 10-2007-0012756 | | | 1/2007 |
| KR | 2007012756 | A | * | 1/2007 |
| KR | 10-2007-0099777 | | | 10/2007 |
| KR | 2007099777 | A | * | 10/2007 |
| WO | PCT/US2010/028795 | | | 11/2010 |
| WO | PCT/US2010/028795 | | | 10/2011 |

* cited by examiner

ELECTRONIC GUIDES, INCIDENT RESPONSE METHODS, INCIDENT RESPONSE SYSTEMS, AND INCIDENT MONITORING METHODS

CROSS REFERENCE TO RELATED APPLICATION

This application is a continuation of U.S. patent application Ser. No. 12/415,701, which was filed on Mar. 31, 2009 now U.S. Pat. No. 8,228,176 and which is incorporated herein by reference.

TECHNICAL FIELD

The present invention, in various embodiments, relates to electronic guides, incident response methods, incident response systems, and incident monitoring methods.

BACKGROUND

Alarm systems that monitor for dangerous conditions such as smoke, fire, water, or other property or life threatening conditions are commonplace in finished buildings and other venues. These systems help promote safety by alerting occupants of dangerous conditions so that they can evacuate. Venues that are under construction, however, do not have such systems in place. Accordingly, it can be difficult to quickly notify those working on the venue of dangerous conditions.

Although alarm systems may notify occupants of dangerous conditions, they do not attempt to direct the occupants away from the dangerous conditions. Instead, occupants may rely on fixed evacuation routes described in emergency plans or on exit signs. These routes are typically designed to be the shortest routes out of the building. Depending on the conditions, a shortest route, however, might not be the safest way to exit a building. In some cases, following a fixed route or exit sign may actually lead one into the dangerous conditions.

BRIEF DESCRIPTION OF THE DRAWINGS

Preferred embodiments are described below with reference to the following accompanying drawings.

FIG. 7A depicts a Graphical User Interface (GUI) at a first moment in time in accordance with an embodiment.

FIG. 7C depicts a Graphical User Interface (GUI) at a third moment in time in accordance with an embodiment.

FIG. 7D depicts a Graphical User Interface (GUI) at a fourth moment in time in accordance with an embodiment.

DETAILED DESCRIPTION

Electronic guides, incident response methods, incident response systems, and incident monitoring methods are described. In one embodiment, a system includes electronic guides that are controlled by management circuitry in order to safely lead people out of a venue in the case of an incident such as a fire, gas leak, security threat, or terrorist attack.

According to one aspect of the invention, an electronic guide includes one or more indicators and processing circuitry. The processing circuitry is configured to receive a request to configure the one or more indicators from an inactive state to an active state in which the one or more indicators encourage a first person positioned near a first side of the electronic guide to move toward the electronic guide and encourage a second person positioned near a second side of the electronic guide to move away from the electronic guide. The processing circuitry is also configured to configure the one or more indicators according to the request.

The processing circuitry may also be configured to receive the request via a wireless communications channel.

The one or more indicators may include a first visual indicator viewable from a first location near the electronic guide and a second visual indicator viewable from a second location near the electronic guide wherein the first visual indicator is not viewable from the second location and the second visual indicator is not viewable from the first location. When the one or more indicators are configured in the active state, the first visual indicator may be a first color and the second visual indicator may be a second color.

Figure 1:
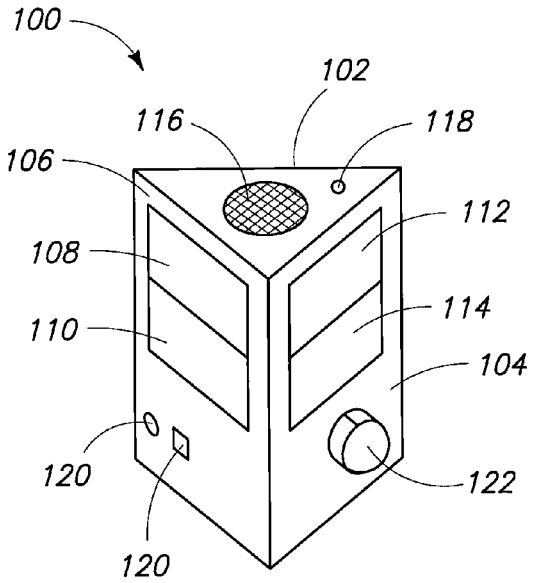
FIG. 1 is an illustration of an electronic guide in accordance with an embodiment.

Referring to FIG. 1, one embodiment of an electronic guide 100 is illustrated. Electronic guide 100 includes faces 102, 104, and 106. In one embodiment, face 102 may be mounted against a wall, ceiling, or floor.

Face 106 includes two indicators 108 and 110 and face 104 includes two indicators 112 and 114. Indicators 108, 110, 112, and 114 may be visual indicators that may be individually selectively enabled. In one embodiment, indicators 108, 110, 112, and 114 may include light bulbs or LEDs of one or more colors that may be selectively enabled. In one embodiment, indicators 108, 110, 112, and 114 may be configured to display a symbol such as an arrow, a word, a letter, or other symbol.

In one embodiment, one or more of indicators 108, 110, 112, and 114 may be configured to encourage a person located to the right of face 104 to move toward electronic guide 100. For example, indicator 114 may include a plurality of green, white, or other color (or multicolor) LEDs formed in the shape of a horizontally oriented arrow pointing left. Upon seeing the arrow, the person may move toward electronic guide 100.

Alternatively, indicator 114 may be configured so that indicator 114 is green. This may be accomplished, for example, by activating green LEDs or light bulbs, by activating a light source behind a piece of green translucent material, or by physically revealing a piece of green material. Since green is internationally associated with the word "go" due to its use in traffic lights, upon seeing that indicator 114 is green, the person may move toward electronic guide 100.

Indicators 108, 110, and/or 112 may be similarly configured to encourage a person located to the right of face 104 to move toward electronic guide 100.

In one embodiment, one or more of indicators 108, 110, 112, and 114 may be configured to encourage a person located to the right of face 104 to move away from electronic guide 100. For example, indicator 114 may include a plurality of green, white, other color (or multicolor) LEDs formed in the shape of a horizontally oriented arrow pointing right. Upon seeing the arrow, the person may move away from electronic guide 100 since the arrow points away from electronic guide 100.

Alternatively, indicator 112 may be configured so that indicator 112 is red. This may be accomplished, for example, by activating red LEDs or light bulbs, by activating a light source behind a piece of red translucent material, or by physically revealing a piece of red material. Since red is internationally associated with the word "stop" due to its use in traffic lights, upon seeing that indicator 112 is red, the person may move away from electronic guide 100. Indicators 108, 110, and/or 114 may be similarly configured to encourage a person located to the right of face 104 to move away from electronic guide 100.

Indicators 108, 110, 112, and 114 may be activated using the techniques described above to encourage a person located to the left of face 106 to either move toward or move away from electronic guide 100. These techniques may be used in conjunction so that a person located to the right of face 104 is encouraged to move toward electronic guide 100 and then upon reaching electronic guide 100 is encouraged to move away from electronic guide 100 in a direction to the left of electronic guide 100. For example, indicators 112 and 108 may each be configured to display arrows pointing left or indicator 114 may be configured so that indicator 114 is green and indicator 108 may be configured so that indicator 108 is red.

Indicators 108, 110, 112, and 114 may be implemented using one or more of LEDs, light bulbs, LCD displays, electronic paper, painted material, and/or translucent colored material. Indicators 108, 110, 112, and 114 may be configured to blink. The frequency and/or duty cycle of the blink may be used to convey information. In some embodiments, indicators 108, 110, 112, and 114 may be chosen so that they are easily recognized by a human or animal. In other embodiments, indicators 108, 110, 112, and 114 may be chosen so that they are easily recognized by a moveable device such as a robot.

In one embodiment, face 104 and indicators 112 and 114 may be visible to a person approaching guide 100 from the right but not to a person approaching guide 100 from the left and face 106 and indicators 108 and 110 may be visible to a person approaching guide 100 from the left but not to a person approaching guide 100 from the right.

In one embodiment, electronic guide 100 may include a speaker or other device 116 configured to produce an audible indicator, such as a beep, tone, siren, or verbal message. The audible indicator may be used to encourage a person to move toward or away from electronic guide 100 as is described below. Device 116 may alternatively or additionally be used in conjunction with a microphone 118 to enable a person located near electronic guide 100 to communicate with a person operating management circuitry 400 (described below). Furthermore, device 116 may be used to play recorded verbal instructions such as "follow the green lights to an exit," or "follow the arrows to an exit," or "follow the chirp to an exit."

In one embodiment, electronic guide 100 may include a switch 122 configured to be manually activated by a person. Switch 122 may be used by the person to indicate that an incident, such as an injury, fire, or non-specified emergency has occurred. For example, switch 122 may be a "panic button" that may be pushed by the person. In some embodiments, switch 122 may be configured to prevent accidental activation. For example, switch 122 may be behind a protective cover that prevents switch 122 from being manually activated while the protective cover is in place. In case of an emergency a person may move or remove the protective cover to gain access to switch 122. In one embodiment, electronic guide 100 may be mounted on a ceiling or pole and switch 122 may include a pull chain used to activate switch 122.

Of course, other embodiments of electronic guides are possible that include some or all of the components described above or that include a greater or lesser number of the components described above. For example, in one embodiment, an electronic guide may have a single visual indicator (such as indicator 112) that can be configured to display either an arrow pointing left or an arrow pointing right. This electronic guide may have a flat front face to which the single visual indicator is affixed.

Figure 2:
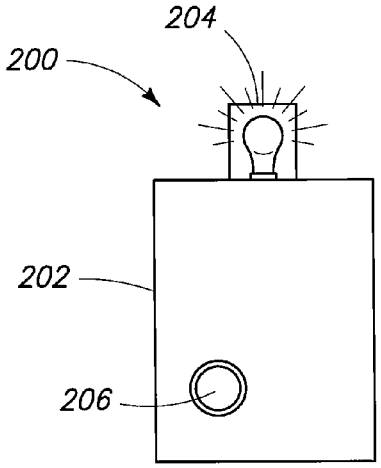
FIG. 2 is an illustration of an electronic guide in accordance with an embodiment.

Referring to FIG. 2, another embodiment of an electronic guide 200 is illustrated. Electronic guide 200 includes a switch 206 similar in functionality to switch 122 described above, and a visual indicator 204.

In one embodiment, upon the occurrence of an incident, a person may activate switch 206 and, in response, visual indicator 204 may be activated to draw attention to electronic guide 200. This behavior may be well suited to venues such as manufacturing facilities or construction sites in which incidents such as injury or fire should be made immediately known to others. Visual indicator 204 may guide a person responding to the incident to electronic guide 200.

In some embodiments, electronic guide 200 may be self-powered, free-standing, and self-contained and therefore well-suited for use in a construction site in which walls and power have not yet been constructed an in which built-in safety systems, such as fire alarm systems, have not yet been installed.

Electronic guide 200 may also include processing circuitry such as processing circuitry 302 described below and/or a cabinet in which emergency supplies may be stored. Examples of emergency supplies include a fire extinguisher, eyewash kit, first-aid kit, flashlight, gas mask, and CPR instructions.

Figure 3:
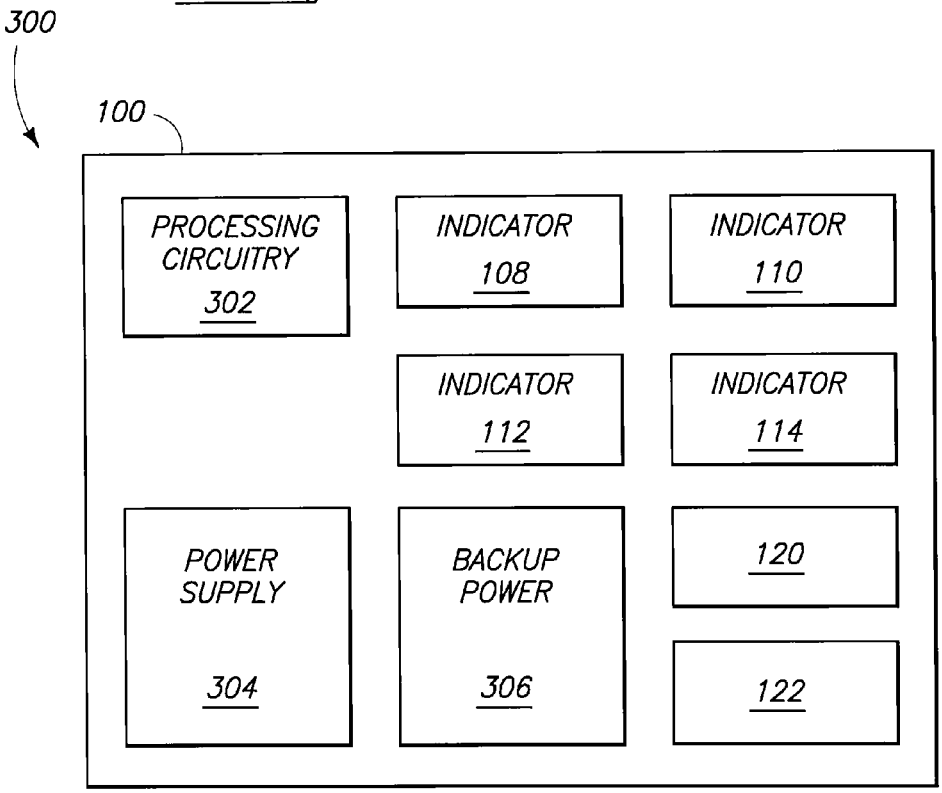
FIG. 3 is a block diagram in accordance with an embodiment.

Referring to FIG. 3, one embodiment of a block diagram 300 of electronic guide 100 is illustrated. As illustrated by block diagram 300, electronic guide 100 includes elements not illustrated in FIG. 1 such as processing circuitry 302 and power supply 304. Electronic guide 100 may also optionally include backup power supply 306. Blocks representing indicators 108, 110, 112, and 114 and sensors 120 are also included in block diagram 300.

Processing circuitry 302 may interact with other elements of electronic guide 100. For example, processing circuitry 302 may enable or disable indicators 108, 110, 112, and 114; may detect when switch 122 has been activated; provide electronic signals to device 116; and/or process audio signals captured by microphone 118. Processing circuitry 302 may report events to management circuitry 400 and receive instructions and/or requests from management circuitry 400.

Electronic guide 100 may include one or more environmental sensors 120 (see FIG. 1) and processing circuitry 302 may be configured to store data acquired by sensors 120 and to send the data acquired by sensors 120 to management circuitry 400 (described below). Examples of sensors 120 include sensors for measuring temperature, humidity, radiation, or light and sensors for detecting smoke, gas, fire, heat, water, or pressure.

In some embodiments, electronic guide 100 may include a motion detector configured to detect motion near electronic guide 100. Processing circuitry 302 may communicate with the motion detector and may notify management circuitry 400 when motion has been detected. Furthermore, processing circuitry 302 may activate one or more of indicators 108, 110, 112, and 114 when motion has been detected to notify people near electronic guide 100 that motion has been detected.

Processing circuitry 302 may comprise circuitry configured to implement desired programming provided by appropriate media in at least one embodiment. For example, processing circuitry 302 may be implemented as one or more of a processor and/or other structure configured to execute executable instructions including, for example, software and/or firmware instructions, and/or hardware circuitry. Exemplary embodiments of processing circuitry 302 include hardware logic, PGA, FPGA, ASIC, state machines, and/or other structures alone or in combination with a processor. These examples of processing circuitry 302 are provided by way of illustration; other configurations are possible.

Processing circuitry 302 may execute programming stored within appropriate processor-usable media and/or communicated via a network or other transmission media. The programming may be provided to processing circuitry 302 via appropriate media including, for example, embodied within articles of manufacture, embodied within a data signal (e.g., modulated carrier wave, data packets, digital representations, etc.) communicated via an appropriate transmission medium, such as a communication network (e.g., the Internet and/or a private network), wired electrical connection, optical connection and/or electromagnetic energy, for example, via a communications interface, or provided using other appropriate communication structure or medium. Exemplary programming including processor-usable code may be communicated as a data signal embodied in a carrier wave in but one example.

Power supply 304 may provide electrical power (e.g., AC or DC power) to the other elements of electronic guide 100. In one embodiment, power supply 304 may be connected to standard AC power via a hard-wired connection. In another embodiment, power supply 304 may include a plug that may be plugged into a standard AC power receptacle. In some cases, power supply 304 may include one or more batteries and might not rely on standard AC power.

Backup power supply 306 may supply power to electronic guide 100 in situations in which power supply 304 is unable to do so. Backup power supply 306 may include one or more batteries.

Figure 4:
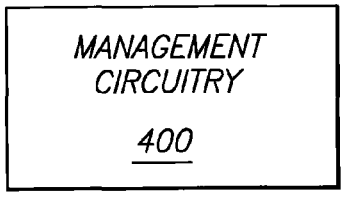
FIG. 4 is a block diagram in accordance with an embodiment.

Referring to FIG. 4, a block diagram of management circuitry 400 is illustrated. Management circuitry 400 may be in communication with one or more electronic guides such as electronic guide 100 and may control and/or configure the electronic guides.

In some embodiments, management circuitry 400 may be electrically connected to electronic guide 100 via wiring. In other embodiments, management circuitry 400 may communicate with processing circuitry 302 via one or more wireless communication channels. For example, management circuitry 400 may communicate with processing circuitry 302 via a radio channel or via an infrared link. The wireless communications channel may be Bluetooth channel or may be part of a wireless network such as an IEEE 802.11 network or a cellular network.

Management circuitry 400 may be remotely located from electronic guide 100 so that incidents affecting electronic guide 100 do not necessarily affect management circuitry 400. For example, if electronic guide 100 is located in a passageway of a building (e.g., a hallway), management circuitry 400 may be located in a security room of the building and may be located on a different floor of the building. In some embodiments, management circuitry 400 may be located in a different building than the building in which electronic guide 100 is located.

In one embodiment, management circuitry 400 may be portable and may be carried around by a person having responsibility for monitoring electronic guide 100. Management circuitry 400 may include a speaker and microphone that may be used in conjunction with device 116 and microphone 118 to enable a person operating management circuitry 400 to verbally communicate with a person located near electronic guide 100.

Management circuitry 400 may comprise circuitry configured to implement desired programming provided by appropriate media in at least one embodiment. For example, management circuitry 400 may be implemented as one or more of a processor and/or other structure configured to execute executable instructions including, for example, software and/or firmware instructions, and/or hardware circuitry. Exemplary embodiments of management circuitry 400 include hardware logic, PGA, FPGA, ASIC, state machines, and/or other structures alone or in combination with a processor. These examples of management circuitry 400 are provided by way of illustration; other configurations are possible.

Management circuitry 400 may execute programming stored within appropriate processor-usable media and/or communicated via a network or other transmission media. The programming may be provided to management circuitry 400 via appropriate media including, for example, embodied within articles of manufacture, embodied within a data signal (e.g., modulated carrier wave, data packets, digital representations, etc.) communicated via an appropriate transmission medium, such as a communication network (e.g., the Internet and/or a private network), wired electrical connection, optical connection and/or electromagnetic energy, for example, via a communications interface, or provided using other appropriate communication structure or medium. Exemplary programming including processor-usable code may be communicated as a data signal embodied in a carrier wave in but one example.

Some example implementations of management circuitry 400 include a computer, laptop, PDA, and a handheld computer. Each of these devices may execute programming configured to perform the methods described herein.

In one embodiment, processing circuitry 302 may be configured to receive a status request from management circuitry 400, which may be remotely located from the electronic guide 100. Processing circuitry 302 may send a status message to management circuitry 400 in response to receiving the status request. The status request may be a "ping" and the status message may be a "ping" response. In one embodiment, the status message may include information about electronic guide 100 and may include a time stamp. For example, the status message may include an identifier associated with electronic guide 100 such as a name, address, or serial number.

Figure 5A:
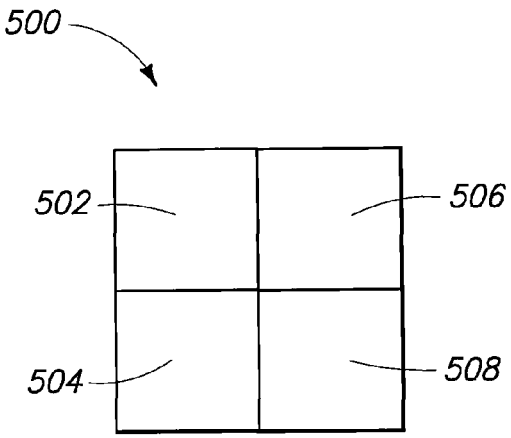
FIG. 5A is a first symbol in accordance with an embodiment.

Referring to FIG. 5A, a symbol 500 representing an electronic guide having four indicators 502, 504, 506, and 508 is illustrated. The electronic guide represented by symbol 500 may have some or all of the functionality of the electronic guides described herein (e.g., electronic guides 100 and 200) and indicators 502, 504, 506, and 508 may have some or all of the functionality of the visual indicators described herein (e.g., indicators 108, 110, 112, and 114). Furthermore, although symbol 500 (and symbols 510, 512, and 514) is illustrated diagrammatically in two dimensions, the electronic guides represented by these symbols may be three dimensional, for example, like electronic guide 100.

The placement of indicators 502 and 504 on the left side of the symbol is used to indicate that indicators 502 and 504 are detectable to a person, animal, or device located to the left of the electronic guide represented by symbol 500 and the placement of indicators 506 and 508 on the right side of the symbol is used to indicate that indicators 506 and 508 are detectable to a person, animal, or device located to the right of the electronic guide represented by symbol 500.

Figure 5B:
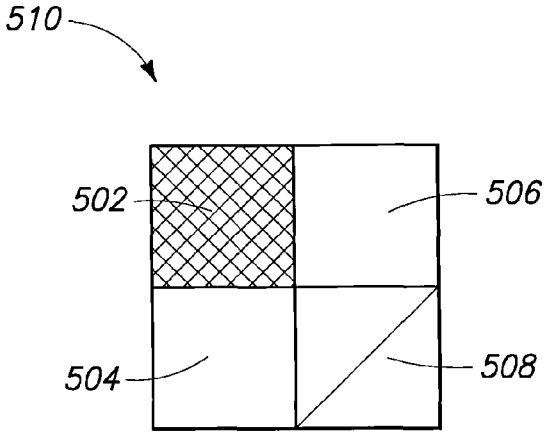
FIG. 5B is a second symbol in accordance with an embodiment.

Referring to FIG. 5B, a symbol 510 representing an electronic guide in which indicators 502 and 508 have been activated is illustrated. Indicator 502 is shaded to convey that it is configured to encourage a person, animal, or moveable device positioned to the left of the electronic guide represented by symbol 510 to move away from the electronic guide. As was described above, when configured in this mode indicator 502 may, for example, display the color red.

The slash through indicator 508 conveys that indicator 508 is configured to encourage a person, animal, or moveable device positioned to the right of the electronic guide represented by symbol 510 to move toward the electronic guide. As was described above, when configured in this mode indicator 502 may, for example, display the color green.

Figure 5C:
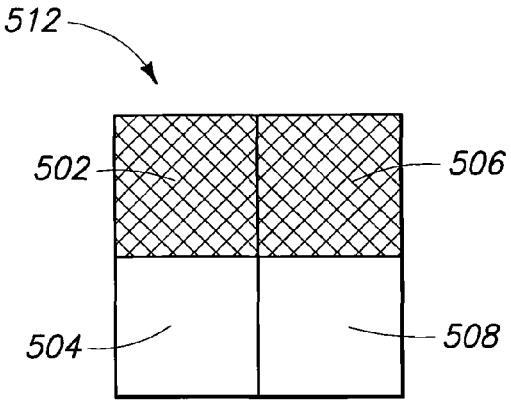
FIG. 5C is a third symbol in accordance with an embodiment.

Referring to FIG. 5C, a symbol 512 representing an electronic guide in which indicators 502 and 506 have been activated is illustrated. Indicators 502 and 506 are shaded to convey that indicators 502 and 506 are configured to encourage a person, animal, or moveable device to the left or right of the electronic guide represented by symbol 512 to move away from the electronic guide. As was described above, when configured in this mode indicators 502 and 506 may, for example, display the color red.

Figure 5D:
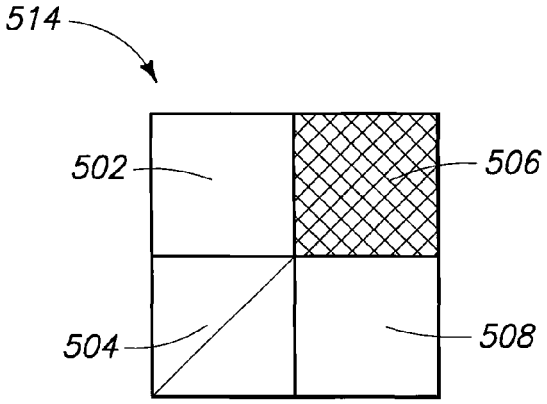
FIG. 5D is a fourth symbol in accordance with an embodiment.

Referring to FIG. 5D, a symbol 514 representing an electronic guide in which indicators 504 and 506 have been activated is illustrated. The slash through indicator 504 conveys that indicator 504 is configured to encourage a person, animal, or moveable device to the left of the electronic guide represented by symbol 514 to move toward the electronic guide. As was described above, when configured in this mode indicator 504 may, for example, display the color green.

Indicator 506 is shaded to convey that indicator 506 is configured to encourage a person, animal, or moveable device to the right of the electronic guide represented by symbol 514 to move away from the electronic guide. As was described above, when configured in this mode indicator 506 may, for example, display the color red.

Symbols 510, 512, and 514 are used in FIGS. 6B, 6C, 7A, 7B, 7C, and 7D to represent configurations of electronic guides. In some cases, these symbols are rotated by ninety degrees.

As was mentioned above, electronic guides may be placed within a venue. In response to an incident occurring within the venue, the electronic guides may be configured to guide people away from the incident and out of the venue, thereby potentially reducing confusion and saving lives, or to guide people (such as first responders) to the incident, thereby potentially reducing the time required to resolve the incident. Resolving the incident quickly may reduce property loss.

Figure 6A:
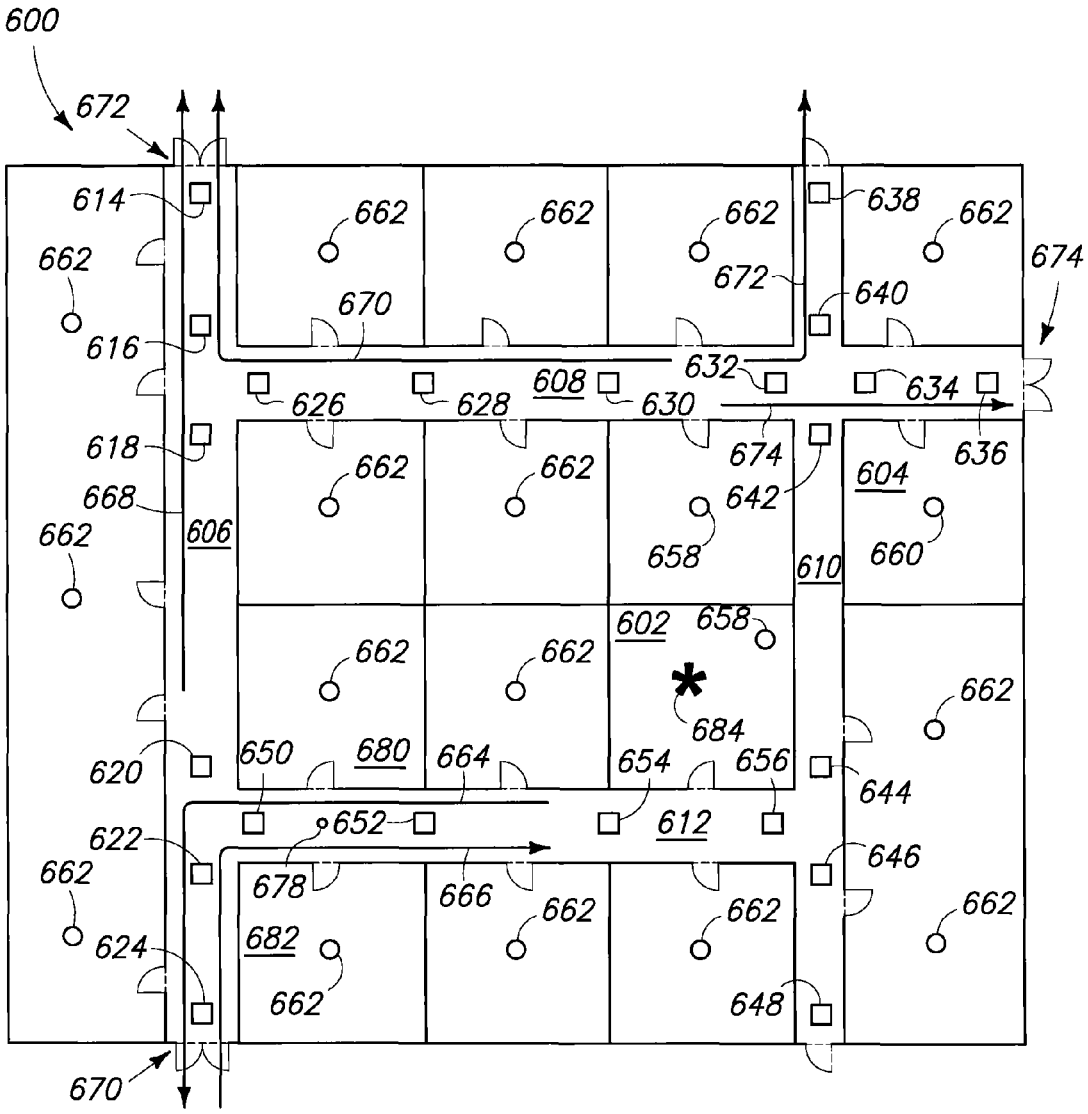
FIG. 6A is a floor plan in accordance with an embodiment.

Referring to FIG. 6A, a floor plan 600 of a building is illustrated. Floor plan 600 includes pathways (i.e., hallways) 606, 608, 610, and 612; rooms; exits 670 and 672; and detectors 658, 660, and 662. Detectors 658, 660, and 662 may be configured to monitor an environmental condition and may include smoke, heat, leak, flow, gas, and fume detectors.

Floor plan 600 also includes electronic guides 614, 616, 618, 620, 622, and 624 located in pathway 606; electronic guides 626, 628, 630, 632, 634, and 636 located in pathway 608; electronic guides 650, 652, 654, and 656 located in pathway 612; and electronic guides 638, 640, 642, 644, 646, and 648 located in pathway 610. The electronic guides of FIG. 6A may be in communication with management system 400 and may be mounted on walls, ceilings, or floors of the pathways.

Floor plan 600 is used below to describe incident response systems and methods.

According to one aspect of the invention, an incident response system includes a plurality of electronic guides positioned within pathways of a building in different locations relative to one another. The system may be referred to as a Dynamic Directional Emergency Response and Egress System. Each electronic guide of the plurality includes at least one visual arrow configured to be selectively enabled. The incident response system also includes management circuitry configured to receive notification that an incident has occurred within the building; determine a source of the notification, the source being positioned in a location near the incident; and establish a directional path through the pathways leading away from the location toward an exit of the building by enabling the visual arrows of the electronic guides of the plurality that are positioned along the directional path, individual of the visual arrows being visible to a person traversing the directional path.

FIG. 6A may be used to illustrate the operation of such a system. For example, an incident (e.g., a fire, gas leak, injury, terrorist threat, etc.) 684 may occur in room 602. Detector 658 (e.g., a smoke alarm, gas detector, motion detector, etc.) may detect the incident and report the incident directly to management circuitry 400 or indirectly to management circuitry 400 via an alarm panel associated with the detector.

Upon receiving notification of the incident, management circuitry may determine that the source of the notification is detector 658. Management circuitry 400 may then establish directional paths through pathways 606, 608, 610, and 612 leading away from incident 684 toward an exit of the building. To do so, management circuitry 400 may communicate with the electronic guides of FIG. 6A and configure the electronic guides to display arrows pointing in the directions of paths 664, 668, 670, 672, and 674. For example, management circuitry 400 may configure electronic guides 626, 628, 650, 652, and 654 to display arrows pointing to the left side of the floor plan, electronic guides 630, 632, 634, 636, and 656 to display arrows pointing to the left side of the floor plan, electronic guides 620, 622, 624, 644, 646, and 648 to display arrows pointing to the bottom side of the floor plan, and electronic guides 618, 616, 614, 640, 638, and 642 to display arrows pointing to the top side of the floor plan.

As a result of detector 658 detecting incident 684, an audible alarm signal (e.g., fire alarm signal) may be generated within the building that notifies people within the building that they should evacuate. The directional paths established by management circuitry 400 may lead people out of the building and away from incident 684. For example, upon exiting room 680, a person may look left and see electronic guide 652 displaying an arrow pointing away from electronic guide 652 and toward electronic guide 650. The person may look right and see electronic guide 650 displaying an arrow pointing away from electronic guide 650 and towards pathway 606. Based on viewing one or both of these electronic guides, the person may move towards electronic guide 650 rather than towards electronic guide 652.

Upon reaching the intersection of pathway 612 and pathway 606, the person may look left and see electronic guide 622 displaying an arrow pointing toward electronic guide 624. The person may look right and see electronic guide 620 displaying an arrow pointing away from electronic guide 620 and towards electronic guide 622. Based on viewing one or both of these electronic guides, the person may move along path 664 towards electronic guide 622 and exit 670 rather than towards electronic guide 620.

Configuring the electronic guides of FIG. 6A to display arrows may be helpful to those people in the building who are colorblind since the arrows do not rely on color to indicate the evacuation path.

In some cases, a first responder (e.g., fire, police, or medical personnel) may need to travel towards incident 684 to help resolve the incident 684. For example, if incident 684 is an injury, the first responder may be a paramedic who needs to reach the injured person or if incident 684 is a threat by a terrorist, the first responder may be a police officer who needs to reach the terrorist. Such first responders may be trained to travel in a direction opposite that of the arrows to be led to incident 684.

For example, a first responder entering the building via exit 670 may travel in a direction opposite that indicated by the arrows displayed by electronic guides 624, 622, 650, 652, and 654 and thereby may be led along path 666 towards incident 684.

Instead of or in addition to configuring the electronic guides of FIG. 6A to display the arrows described above, management circuitry 400 may configure the electronic guides of FIG. 6A to audibly guide people along paths 664, 668, 670, 672, and 674. Doing so may be useful for those who are blind or who are effectively blinded due to smoke or other conditions resulting from incident 684.

According to another aspect of the invention, an incident response system includes a plurality of electronic guides positioned within pathways of a building in different locations relative to one another. Each electronic guide of the plurality includes at least one audible indicator configured to be selectively enabled. The incident response system also includes management circuitry configured to receive notification that an incident has occurred within the building; determine a source of the notification, the source being positioned in a location near the incident; and establish a directional path through the pathways leading away from the location toward an exit of the building by selectively enabling the audible indicators of the electronic guides of the plurality that are positioned along the directional path, individual of the audible indicators being perceptible to a person traversing the directional path.

FIG. 6A may be used to illustrate the operation of such a system. For example, management circuitry 400 may communicate with the electronic guides of FIG. 6A and configure the electronic guides to generate audible signals leading in the directions of paths 664, 668, 670, 672, and 674. For example, management circuitry 400 may configure electronic guides 652, 650, 622, and 624 to consecutively generate audible chirps in such a way that only one chirp is audible at a time.

As a result, a person standing near electronic guide 652 may hear the chirp generated by electronic guide 652 and may later hear the chirp generated by electronic guide 650. As a result, the person may move along path 664 towards electronic guide 650 since the person heard the chirp from electronic guide 650 after hearing the chirp from electronic guide 652. Upon nearing electronic guide 650, the person may hear another chirp from electronic guide 652 behind him, may then hear another chirp from electronic guide 650, and may then hear a chirp from electronic guide 622. As a result, the person may move along path 664 towards electronic guide 622 since the person heard the chirp from electronic guide 622 after hearing the chirp from electronic guide 650. The person may proceed in this manner along path 664 by listening for chirps from electronic guides 622 and 624.

Following the chirps in this manner may be described as traveling with the chirps since the sequence in which the chirps are emitted leads in the direction of path 664 away from incident 684. In contrast, first responders may travel toward the source of the first chirp in the sequence in a direction opposite that of the sequence to find incident 684.

In one embodiment, the chirps may be generated in such a way that a chirp is only audible within a certain range of the electronic guides that emits the chirp to prevent a person from hearing multiple conflicting chirps in a single location.

In one embodiment, instead of or in addition to configuring the electronic guides to consecutively generate audible chirps in such a way that only one chirp is audible at a time as was described above, management circuitry 400 may configure the electronic guides to consecutively generate visible blinks or pulses of light in such a way that only one blink is visible at a time. In this manner, a path may be established and a person may follow the path by following the consecutive blinks of light.

According to another aspect of the invention, an incident response system includes a plurality of electronic guides positioned within pathways of a building in different locations relative to one another. Each electronic guide of the plurality includes at least one green visual indicator configured to be selectively enabled. The incident response system also includes management circuitry configured to receive notification that an incident has occurred within the building; determine a source of the notification, the source being positioned in a location near the incident; and establish a directional path through the pathways leading away from the location toward an exit of the building by enabling the green visual indicators of the electronic guides of the plurality that are positioned along the directional path. Individual of the green visual indicators are visible to a person traversing the directional path.

In one embodiment, the directional path may be referred to as a first directional path and each electronic guide of the plurality may include at least one red visual indicator configured to be selectively enabled. The management circuitry may be configured to establish a second directional path through the pathways leading from the exit to the location by enabling the red visual indicators of the electronic guides of the plurality that are positioned along the second directional path. The red visual indicators may be visible to a person traversing the second directional path. In some cases, the red visual indicators may be obscured from the view of a person looking in the direction of the first directional path.

Figure 6B:
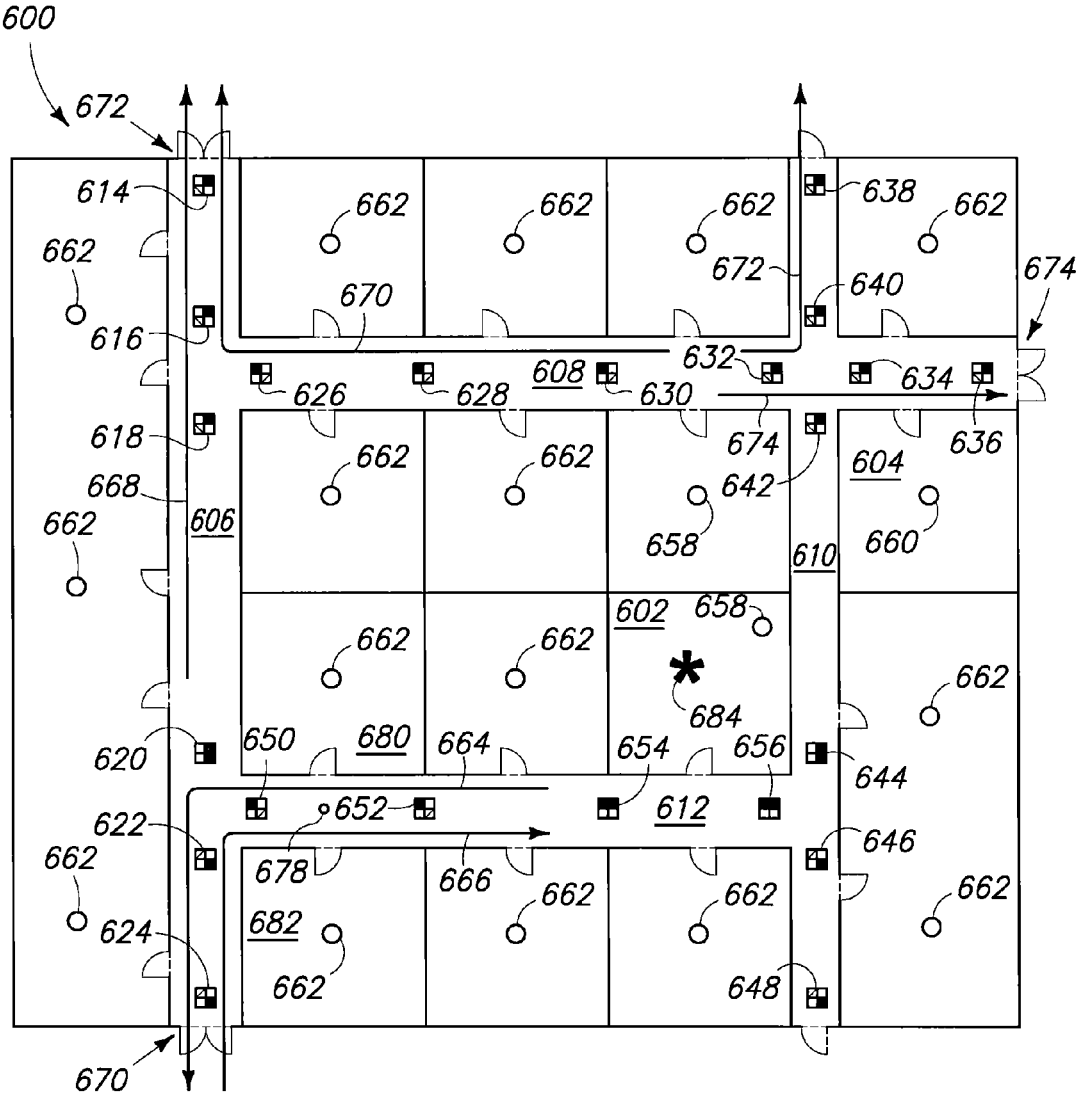
FIG. 6B is a floor plan in accordance with an embodiment.

FIG. 6B may be used to illustrate the operation of such a system. FIG. 6B illustrates the electronic guides of FIG. 6A using symbols 510, 512, and 514 described above in relation to FIGS. 5B, 5C, and 5D. In this embodiment, colors are used to establish paths 668, 670, 674, 664, and 666.

Upon receiving notification of incident 684, management circuitry may determine that the source of the notification is detector 658. Management circuitry 400 may then establish directional paths through pathways 606, 608, 610, and 612 leading away from incident 684 toward an exit of the building. To do so, management circuitry 400 may communicate with the electronic guides of FIG. 6A and configure the electronic guides to display the colors indicated by symbols 510, 512, and 514 in FIG. 6B.

A person evacuating the building because of incident 684 may use the colors of the electronic guides to follow one or more of paths 668, 670, 674, 664, and 666. For example, upon exiting room 680, a person may look left and see red indicator 502 of electronic guide 652. The person may look right and see green indicator 508 of electronic guide 650. Based on viewing one or both of these electronic guides, the person may move towards electronic guide 650 rather than towards electronic guide 652 since green indicates go and red indicates stop.

Upon reaching the intersection of pathway 612 and pathway 606, the person may look left and see green indicator 508 of electronic guide 622. The person may look right and see red indicator 506 of electronic guide 620. Based on viewing one or both of these electronic guides, the person may move along path 664 towards electronic guide 622 and exit 670 and in the direction of the green indicators rather than towards electronic guide 620.

First responders may be trained to travel in a direction toward red indicators to be led to incident 684. For example a first responder entering the building via exit 670 may travel toward red indicators displayed by electronic guides 624, 622, 650, 652, and 654 and thereby may be led along path 666 towards incident 684.

Note that although several different types of indicators (e.g., arrows, audible chirps, audible consecutive chirps, visual consecutive blinks, and colors) have been individually described above, in some embodiments, management circuitry 400 may configure the electronic guides to produce more than one or all of these different types of indicators. For example, in one embodiment, management circuitry 400 may configure the electronic guides to produce arrows, consecutive audible chirps, consecutive visual blinks, and red and green colors. Doing so may help the greatest number of people evacuate a venue since those who are vision impaired may rely on the consecutive audible chirps and those who are color blind may rely on the arrows or consecutive visual blinks, thereby increasing building safety with respect to life safety.

Management circuitry 400 may detect a second incident in addition to incident 684. In some cases, the second incident may be detected before incident 684 has been resolved. For example, if incident 684 is a fire and the second incident is also a fire, management circuitry 400 may detect the second incident prior to the fire of incident 684 being extinguished.

Figure 6C:
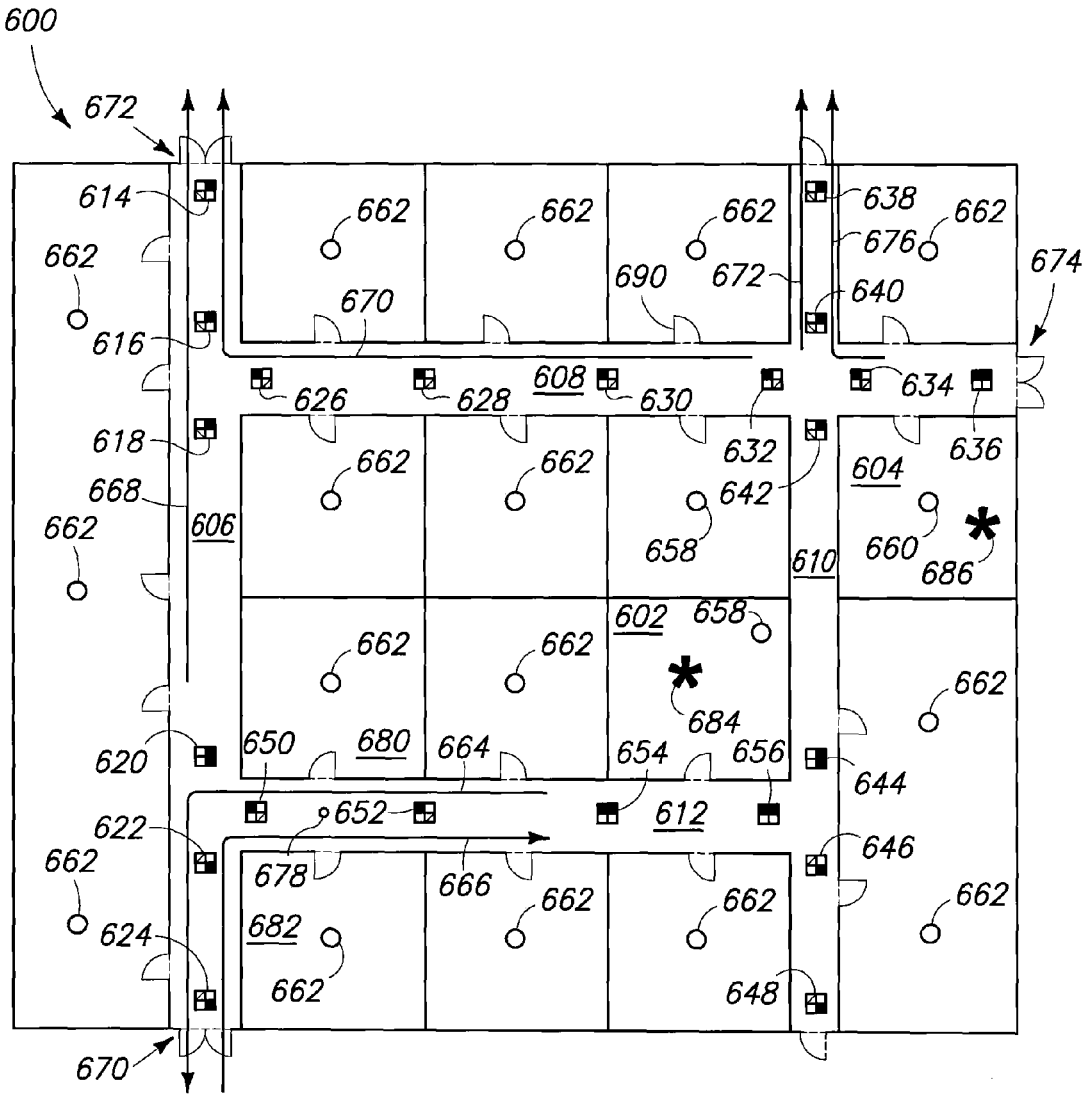
FIG. 6C is a floor plan in accordance with an embodiment.
Figure 11A:
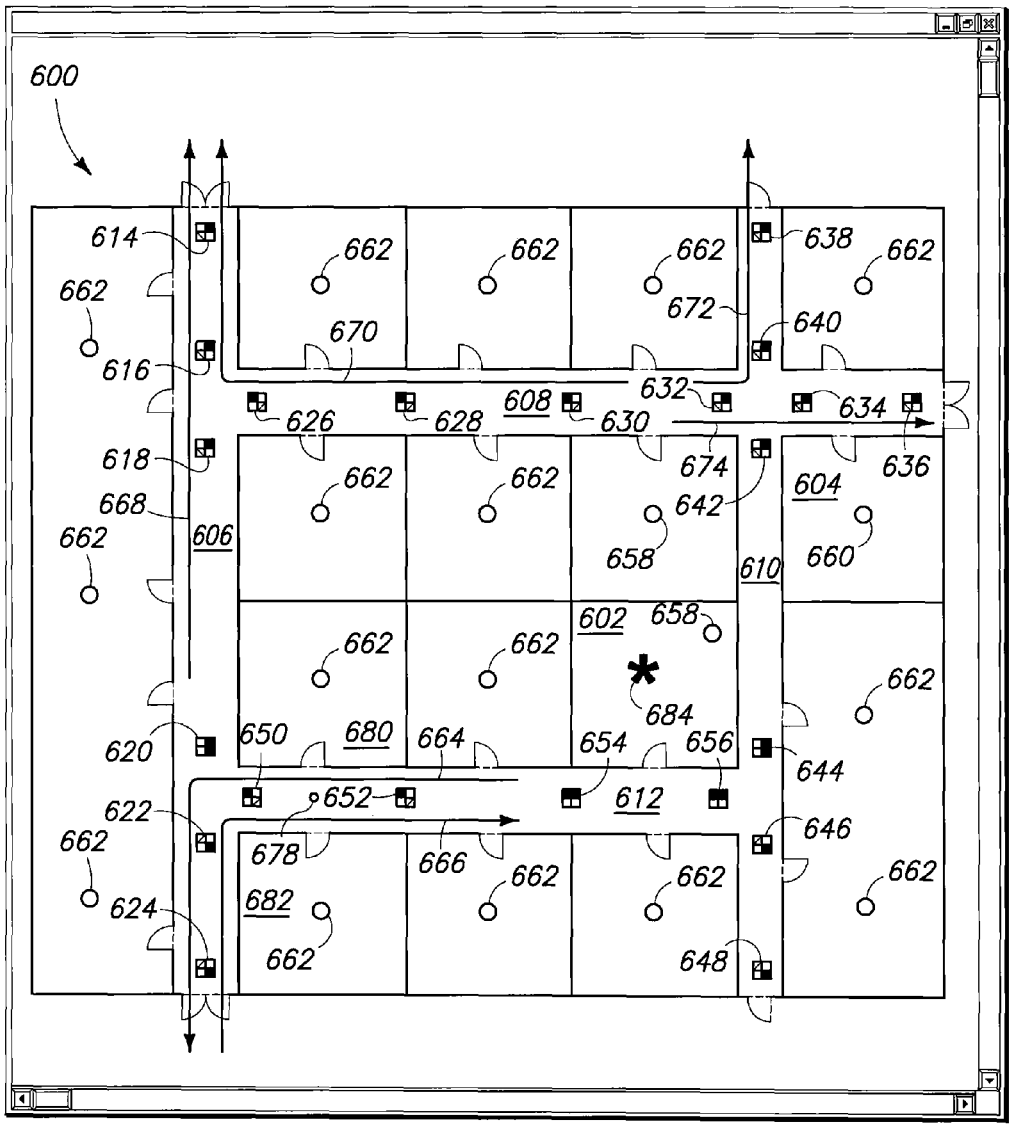

Referring to FIG. 6C, a second incident 686 in room 604 is illustrated. After configuring the electronic guides of FIG. 6C in response to being notified of incident 684, management circuitry 400 may receive notification of incident 686. Incident 686 may be considered remote from incident 684 since incident 686 is located in a different room than incident 684. In response to the notification, management circuitry 400 may determine a source of the second notification, which may be detector 660. Management circuitry 400 may then reconfigure at least a portion of one of guided paths 668, 670, 672, 674, 664, and 666 to lead away from both incident 684 and incident 686.

For example, as illustrated in FIG. 6C, management circuitry 400 may reconfigure the indicators of electronic guides 632, 634, and 636. As a result, path 670 is extended to include electronic guide 632, path 672 is shortened so that is does not include electronic guide 632, and path 676 is created.

Note that a person exiting door 690 into pathway 608 will be directed by path 670 to exit 672 even though exit 674 is nearer door 690 than exit 672. In this case, path 672 from door 690 to exit 672 is safer than a path from door 690 to exit 672 since such a path would lead towards incident 686 rather than away from incident 686 like path 672. Accordingly, in some instances, management circuitry 400 may establish evacuation paths via the electronic guides that are safest paths rather than shortest paths.

Although some of the examples described herein are based on a two dimensional floor plan of a venue, such as floor plan 600, the methods described herein need not be limited to two dimensions. In one embodiment, management circuitry 400 may consider three dimensions of a venue when configuring the electronic guides. For example, if management circuitry 400 is notified of an incident present in the northwest corner of a third floor of a venue, management circuitry 400 may configure electronic guides located within the venue so that people located on floors of the venue above the third floor are directed to stairwells and/or exits located away from the northwest corners of those floors (e.g., stairwells in the southeast corners of those floors) so that these people do not descend towards the incident.

In directing people in three dimensions, the electronic guides may be configured to direct (e.g., using arrows) people up or down in addition to or instead of directing people left or right. Such functionality may be especially useful in or near stairwells of venues.

Management circuitry 400 may perform other methods in addition to those described above including methods described below. In one embodiment, management circuitry 400 may execute programming configured to perform one or more of the methods described herein.

According to another aspect of the invention, an incident response method includes receiving notification that an incident has occurred and determining a source of the notification, the source being near the incident. The method also includes establishing at least one guided path configured to direct a first person, a first animal, or a first movable device positioned near the source away from the incident and/or to direct a second person, a second animal, or a second movable device toward the incident. Management circuitry 400 may perform this method.

The establishing of the at least one guided path may include configuring a plurality of electronic guides, the electronic guides of the plurality being positioned near the incident and in different locations relative to one another.

The establishing of the at least one guided path may include establishing the at least one guided path so that the at least one guided path directs the second person, second animal, or second movable device toward the incident and the second person, second animal, or second movable device is trained to respond to the incident and further comprising configuring at least some of the plurality of electronic guides to prevent people near the incident who are not trained to respond to the incident from hindering the second person, second animal, or second movable device.

The configuring of the plurality of electronic guides may include configuring a first one of the plurality of electronic guides to discourage the first person, first animal, or first movable device from moving toward the first one of the plurality of electronic guides and configuring a second one of the plurality of electronic guides to encourage the first person, first animal, or first movable device to move toward the second one of the plurality of electronic guides.

The guided path may include a plurality of green visual indicators viewable along the guided path. The guided path may be a bi-directional path comprising a plurality of green visual indicators viewable along the guided path in a direction leading away from the incident and a plurality of red visual indicators viewable along the guided path in a direction leading to the incident.

The receiving of the notification may include receiving the notification from one at least one of the electronic guides of the plurality. For example, management circuitry 400 may receive notification from electronic guide 654 that a switch of electronic guide 654 (e.g., switch 122 of FIG. 1) has been activated or electronic guide 654 may include a smoke detector and management circuitry 400 may receive notification from electronic guide 654 that the smoke detector has detected smoke.

The method may further include after the configuring of the plurality of electronic guides, activating a first signal at a first electronic guide of the plurality; after the activating of the first signal, activating a second signal at a second electronic guide of the plurality; and after the activating of the second signal, activating a third signal at a third electronic guide of the plurality. The first, second, and third electronic guides of the plurality may be positioned at different locations along the guided path relative to one another. The second electronic guide of the plurality may be spaced a first distance along the guided path from the first electronic guide of the plurality and the third electronic guide of the plurality may be spaced a second distance along the guided path from the first electronic guide of the plurality. The second distance may be greater than the first distance.

The first, second, and third signals may be visible signals and/or audible signals and/or signals detectable by the first animal, second animal, first moveable device, and/or second moveable device.

The establishing of the at least one guided path may include establishing a plurality of guided paths leading away from the incident. For example, management circuitry 400 may establish paths 664 and 668 as was described above in relation to FIG. 6A.

The location may be within a venue, the first person may be within the venue, and the establishing of the at least one guided path may include establishing the least one guided path so that the at least one guided path leads the first person out of the venue. For example, the venue may be a building as was described above. Alternatively, the venue may be a construction site, park, stadium, theatre, amusement park, manufacturing facility, campus, or other venue, for example a venue in which a concert, carnival, fair, campaign, or public appearance is taking place.

At the time of the establishing of the at least one guided path, a first exit of the venue may be nearer the first person than a second exit of the venue, the source may be nearer the first exit than the second exit, and the establishing of the at least one guided path may include establishing at least one guided path to direct the first person to the second exit. In this case, the guided path may be a safest path instead of a shortest path as was described above in relation to FIG. 6C.

The receiving of the notification may include electronically receiving the notification using management circuitry and the determining of the source of the notification may include using the management circuitry automatically without human intervention to determine the source of the notification. In other words, management circuitry 400 may determine the source of the notification automatically and without human intervention.

The notification may be referred to as a first notification, the incident may be referred to as a first incident, and the source may be referred to as a first source. The method may further include after the receiving of the first notification, receiving a second notification that a second incident has occurred which is remote from the first incident; determining a second source of the second notification, the second source being positioned near the second incident; and re-configuring at least a portion of the at least one guided path so that the at least one guided path leads the first person away from the first incident and away from the second incident. In other words, management circuitry 400 may dynamically alter the configurations of the electronic guides when another incident is detected.

The receiving of the notification may include receiving the notification from a detector system configured to monitor one or more environmental parameters. For example, some or all of detectors 662 of FIG. 6A may belong to a detector system, such as a smoke alarm system, and the detector system may provide notification to management circuitry 400.

The method may further include after the receiving of the notification, notifying a party or individual responsible for resolving the incident of the incident. For example, if the notification is received from a fire detector system, management circuitry 400 may notify a fire department.

The location may be within a venue and the method may further include after the receiving of the notification, locking or unlocking one or more doors of the venue. For example, if the venue is a shopping mall and the incident is a terrorist attack, management circuitry 400 may lock one or more doors of the shopping mall to prevent people from entering an area of the shopping mall in which the incident is taking place.

The guided path may be a bi-directional path comprising a first plurality of visual indicators viewable along the guided path in a direction leading away from the incident and a second plurality of visual indicators viewable along the guided path in a direction leading to the incident, the first plurality of visual indicators having a different appearance than the second plurality of visual indicators. For example, path 664 and path 666 of FIG. 6B may be considered a single bi-directional path.

Prior to the detection of an incident, a user may configure management circuitry 400 with information describing a plurality of different incident scenarios as well as electronic guide configurations associated with the scenarios. For example, for each detector in a building, a safety manager may determine a configuration of the electronic guides that is to be implemented if that detector is activated. Information describing the configurations may then be provided to management circuitry 400 so that when one of the building's detectors is activated, management circuitry 400 knows how to configure the electronic guides. Upon configuring the electronic guides, paths may be established via the electronic guides.

Accordingly, the method may further include receiving information describing a plurality of pre-determined paths from a user prior to the receiving of the notification and based on the determining of the source of the notification, automatically and without user intervention, selecting the at least one guided path using the information.

In some cases, a person using management circuitry 400 may want to override pre-determined paths available to management circuitry 400 by manually telling management circuitry 400 how to configure one or more of the electronic guides. For example, the person may be aware of an incident occurring outside of a building which management circuitry 400 is not aware of and accordingly may manually tell management circuitry 400 how to configure one or more of the electronic guides so as to avoid the outside incident.

Thus, the method may further include after the receiving of the notification and prior to the establishing of the at least one guided path, receiving information describing at least a portion of the at least one guided path from a user and wherein the establishing of the at least one guided path comprises establishing the at least one guided path using the information.

In addition to the methods described above, management circuitry 400 may monitor an incident.

According to another aspect of the invention, an incident monitoring method includes receiving a notification that an incident has occurred; in response to the receiving of the notification, requesting status information from a plurality of electronic guides configured to establish at least one guided path configured to direct a person positioned near the incident away from the incident; receiving the status information from at least some of the electronic guides of the plurality; and providing the status information.

The status information may include environmental data collected by the electronic guides and the method may include time stamping the data and storing the data. The providing of the status information may include displaying the status information on a map, the map illustrating positions of the electronic guides of the plurality relative to one another. The electronic guides of the plurality may be located in a building and the map may include at least one floor plan of the building.

The method may also include representing electronic guides of the plurality from which the status information has not been received on the floor plan.

At least some of the electronic guides of the plurality may include switches configured to be activated by a person positioned adjacent to the at least some of the electronic guides of the plurality and further comprising indicating on the floor plan which switches have been activated.

The method may also include receiving status information related to detectors of a detector system and representing the status information on the floor plan, the detectors being configured to monitor one or more environmental parameters.

Referring to FIG. 7A, a graphical user interface (GUI) is illustrated. Management circuitry 400 may generate the GUI or may provide information to a web browser or other software so that the web browser or other software may generate the GUI. The GUI depicts floor plan 600 of FIG. 6B at a first moment in time. Accordingly, a user viewing the GUI may look at the GUI to see which paths have been established (e.g., path 664) and to see the current configuration of the indicators of the electronic guides. The GUI may use color, blinking, symbols, or other visual indicators to draw attention to portions of the floor plan. For example, the GUI may depict detectors (e.g., detector 658) that have been activated using one color and detectors that have not been activated using a different color. Furthermore, the GUI may depict configurations of the indicators of the electronic guides using color.

During an incident, management circuitry 400 may regularly communicate with the electronic guides to determine whether the electronic guides are functioning. For example, management circuitry 400 may send the electronic guides a message and ask for a reply. If one or more of the electronic guides does not respond to the message, management circuitry may determine that the non-responding electronic guides are no longer operational and may indicate such using the GUI. Accordingly, management circuitry 400 may provide a real-time or near real-time representation of the status of the electronic guides.

For example, the GUI may depict all of the electronic guides of FIG. 6B, as illustrated in FIG. 7A if management circuitry 400 determines that all of the electronic guides are operational (e.g., as a result of receiving reply messages).

Figure 7B:
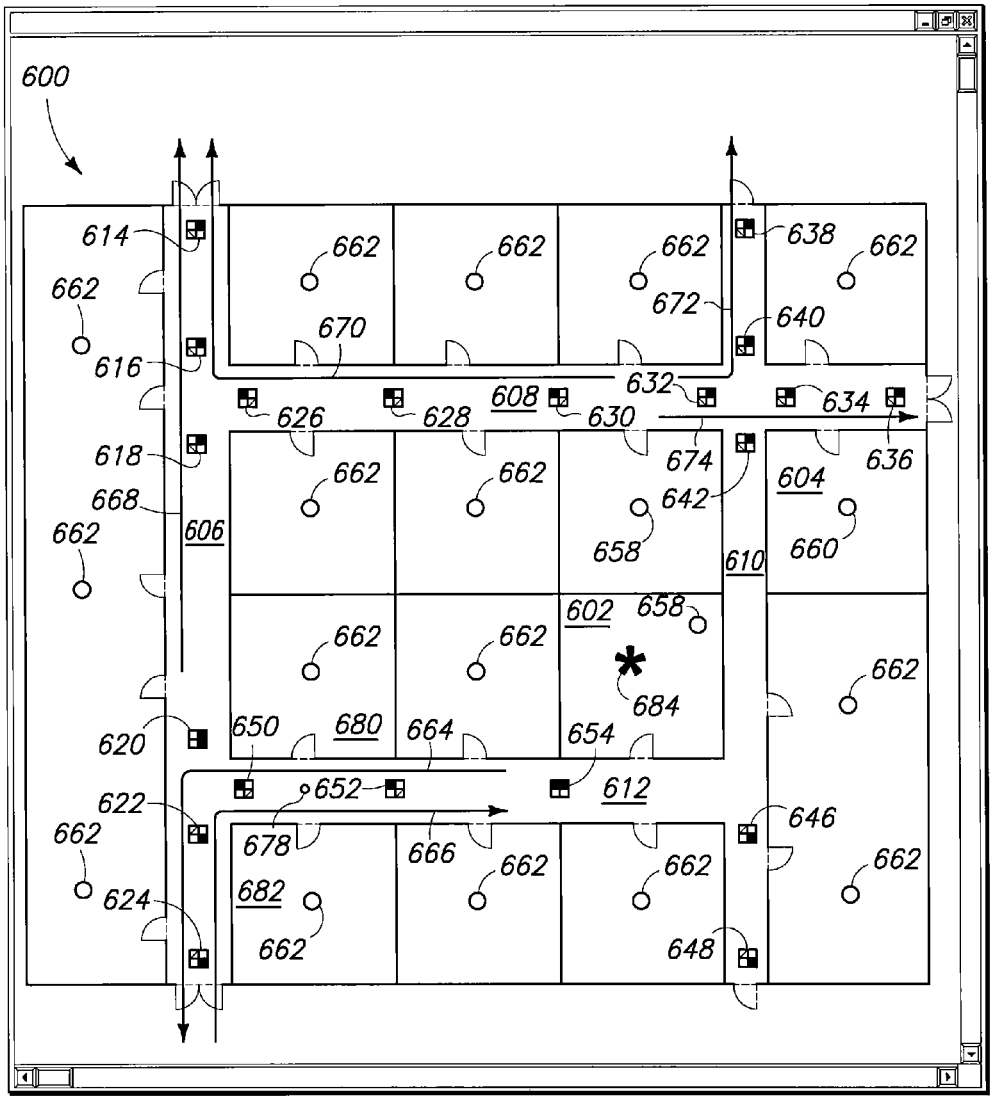
FIG. 7B depicts a Graphical User Interface (GUI) at a second moment in time in accordance with an embodiment.
Figure 11C:
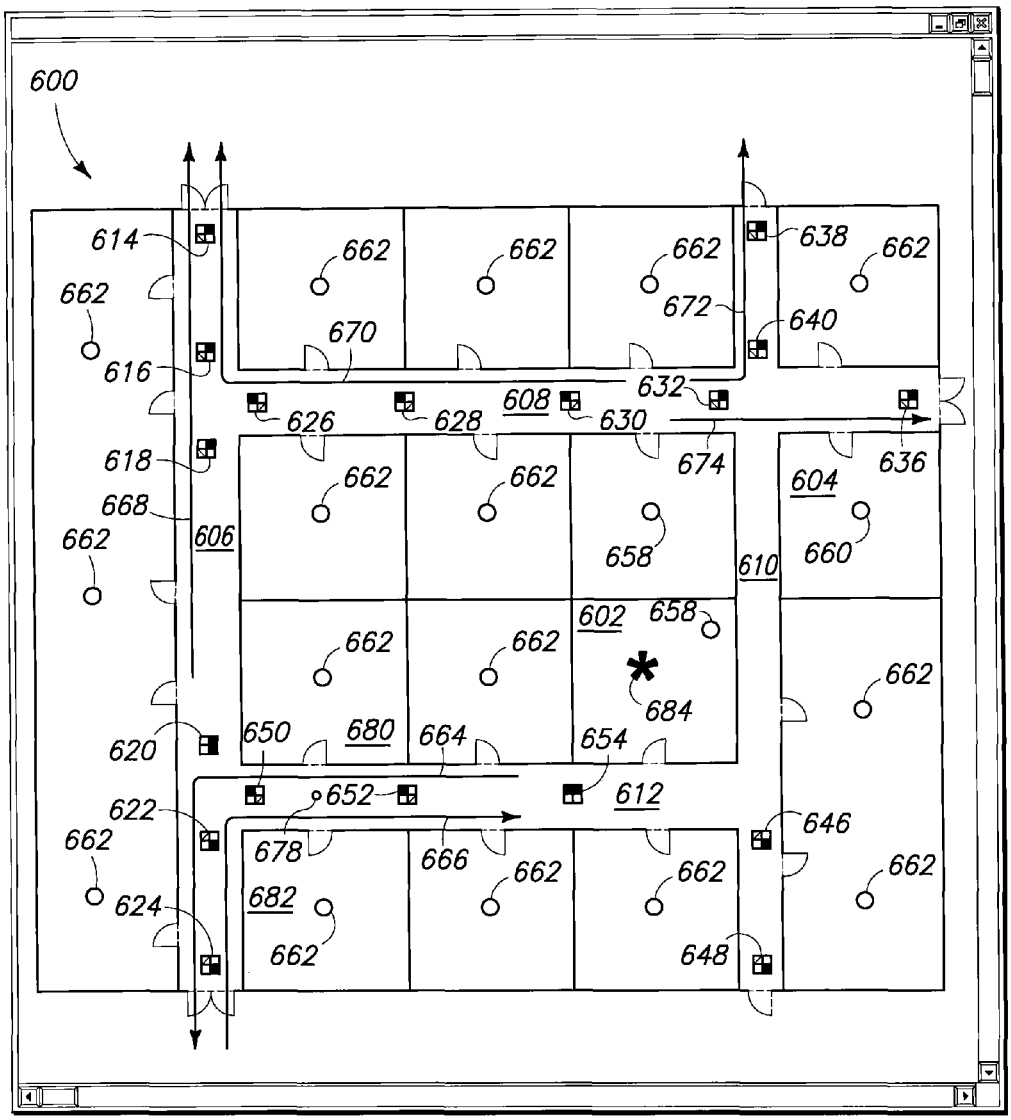

Referring to FIG. 7B, a GUI is illustrated that is identical to the GUI of FIG. 7A except that electronic guides 644 and 656 are not depicted because management circuitry 400 has determined that these electronic guides are non-responsive. The GUI of FIG. 7B may represent the status of the electronic guides at a second moment in time later than the first moment in time.

Referring to FIG. 7C, a GUI is illustrated that is identical to the GUI of FIG. 7B except that electronic guides 642 and 634 are not depicted because management circuitry 400 has determined that these electronic guides are non-responsive. The GUI of FIG. 7C may represent the status of the electronic guides at a third moment in time later than the second moment in time.

Referring to FIG. 7D, a GUI is illustrated that is identical to the GUI of FIG. 7C except that electronic guides 632, 640, 638, and 636 are not depicted because management circuitry 400 has determined that these electronic guides are non-responsive. The GUI of FIG. 7C may represent the status of the electronic guides at a fourth moment in time later than the third moment in time.

A user may infer information about the incident based on the information provided by the GUI. For example, if the incident is a fire, a user viewing the versions of the GUI depicted in FIGS. 7B, 7C, and 7D may infer that the fire is traveling up pathway 610 toward pathway 632. The user may provide the inferred information to first responders, who may use it to their advantage. For example, knowing which way a fire is traveling may affect the way a fire chief directs his firefighters to travel through the building. Accordingly, in some cases, the inferred information may increase first responder safety.

In one embodiment, first responders may be equipped with first responder circuitry that wirelessly communicates with management circuitry 400. The first responder circuitry may include a GPS receiver. In this case, the first responder circuitry may inform management circuitry 400 of a position of the first responder circuitry (and therefore the first responder) within a building. Management circuitry 400 may display a symbol representing the first responder in the GUI so that a person using the GUI may infer the approximate location of the first responder within the building. Based on this information, the person using the GUI may direct the first responder in a particular manner via, for example, a two-way radio.

Additionally or alternatively, the first responder circuitry may wirelessly communicate with one or more of the guides and the guides may communicate with management circuitry 400. In this case, management circuitry 400 may indicate which guides the first responder circuitry is in communication with so that a user of management circuitry 400 may infer an approximate location of the first responder. The guides may receive a unique identifier associated with the first responder from the first responder circuitry and thereby may communicate the identity of the first responder to a user of management circuitry 400. A user of management circuitry 400 may be able to distinguish one first responder from another first responder. In this embodiment, the first responder circuitry might not include a GPS receiver. Instead, the first responder circuitry may be a simple wireless transponder device that responds to wireless signals transmitted by the guides. For example, the guides may include RFID interrogators and the first responder circuitry may include an RFID tag comprising an identifier uniquely associated with the first responder.

Alternatively, rather than not depicting non-responsive electronic guides as illustrated in FIGS. 7B, 7C, and 7D, management circuitry 400 may depict the non-responsive electronic guides in phantom or as blinking icons or using a different color than responsive electronic guides or using some other visual technique so that a user may easily determine locations of the non-responsive guides.

Although FIGS. 7A, 7B, 7C, and 7D depict a single floor of a building, this method of monitoring an incident may be used for multi-floor buildings by using a GUI to depict multiple floors in a three-dimensional model of a building.

Note that in monitoring an incident, it may be preferable to have management circuitry 400 communicate wirelessly with the electronic guides since wiring enabling communication between management circuitry 400 and one of the electronic guides may be destroyed during the incident even if the electronic guide itself is not destroyed, thereby undesirably preventing communication between a functional electronic guide and management circuitry 400.

In one embodiment, management circuitry 400 may request status information from the electronic guides by merely requesting that the electronic guides respond to a request. In other embodiments, management circuitry 400 may request additional information from the electronic guides.

For example, one or more of the electronic guides may include sensors (e.g., sensors 120 of FIG. 1) configured to collect environmental data. The electronic guides may store the data and may provide a copy of the stored data to management circuitry 400 in response to receiving a request from management circuitry 400. Management circuitry 400 and/or the electronic devices may record the time the data was collected by the sensors thereby "time stamping" the data. The data may later be useful in determining the cause of the incident and may be considered forensic data. In one embodiment, the sensors may be temperature sensors and temperature data collected by the sensors may later be used to analyze a way in which a fire spread through a venue.

In one embodiment, one or more of the electronic guides may include manually activated switches (e.g., switch 122) and management circuitry 400 may depict the status of the manually activated switches in the GUI. For example, the GUI may distinguish electronic guides having manually activated switches that have been activated from electronic guides having manually activated switches that have not been activated. Doing so may enable a user to identify situations in which people may be in danger.

For example, if while trying to evacuate a venue, a person becomes injured or is physically prevented from evacuating the venue due to obstructions resulting from the incident, the person may be able to travel to the nearest electronic guide and activate the manually activated switch. Doing do may alert a user of management circuitry 400 that the person needs assistance. In some cases, the person may be a first responder (e.g., firefighter) who needs help. Accordingly, management circuitry 400 may help identify a person who needs assistance during an incidence and may be able to estimate the person's location based on the electronic guide with which the person interacted.

Furthermore, if the electronic guide includes a speaker and microphone, a user of management circuitry 400 may be able to communicate verbally with the person who needs assistance. Doing so may advantageously provide the user of management circuitry 400 with details regarding the assistance that the person needs and/or with information regarding the incident.

In one embodiment, an electronic guide may be configured to recognize when it is not able to communicate with management circuitry 400 and in response configure one or more of its indicators in an active state in which one or more of indicators communicate to people near the electronic guide that the electronic guide is not able to communicate with management circuitry 400.

In one embodiment, the electronic guide may be configured to transmit a wireless beacon signal configured to be received by a locator in response to recognizing that it is not able to communicate with management circuitry 400. The beacon signal may be useful in locating the electronic guide. For example, if the incident involves fire or other structural damage to a building and the building collapses as a result of the incident, the beacon signal may be used to find the electronic guide. Finding the electronic guide may be of interest if a person has activated a manually activated switch of the electronic guide since the person may still be near the electronic guide after the collapse of the building. Accordingly, the beacon signal may be useful in finding missing persons.

Figure 8:
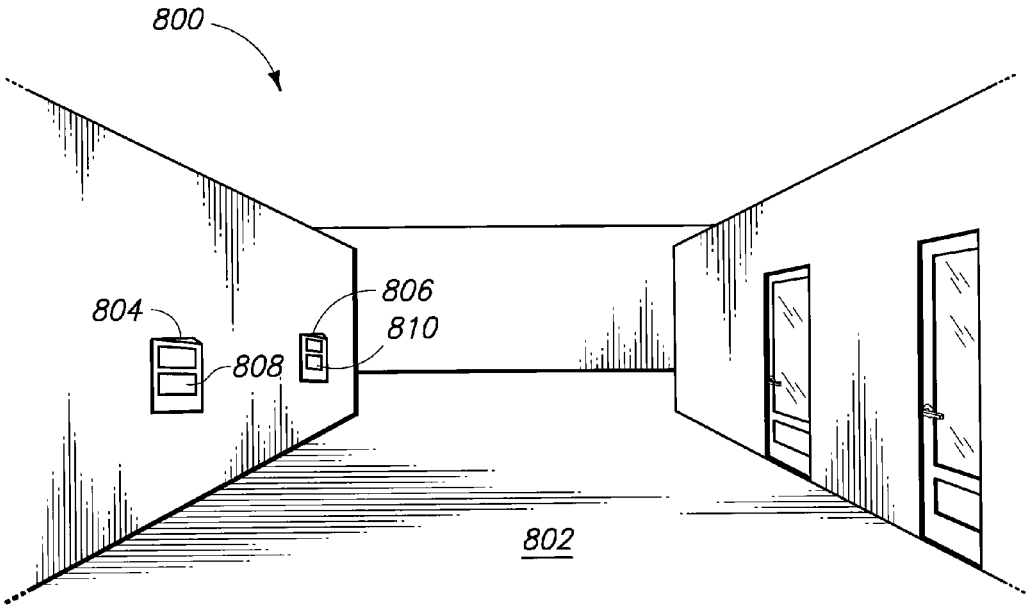
FIG. 8 is an illustration of a first view of a hallway in accordance with an embodiment.

Referring to FIG. 8, a three-dimensional representation 800 of a first view of a building hallway 802 from a location is illustrated. Note that from the location, one face of a triangular electronic guide 804, similar to electronic guide 100, is visible. Indicator 808 is located on the face and may be an activated green indicator. Note that from the location, the other two sides of electronic guide 804 are not visible since one faces the hallway wall and the other faces down hall 802 away from the location. Triangular electronic guide 806 is also visible, as is indicator 810, which may also be an activated green indicator.

Accordingly, a person taking in the first view of hallway 802 may be encouraged to travel down hallway 802 toward electronic guide 804 since green indicators are visible in the first view. Of course, in some instances, a person taking in the first view might not see indicator 810 because smoke or other obstructions resulting from an incident may block his view of indicator 810. Furthermore, in some instances the person might not see either indicator 810 or indicator 808. In these instances, the person might need to proceed down hall 802 until he is able to see indicator 808.

Figure 9:
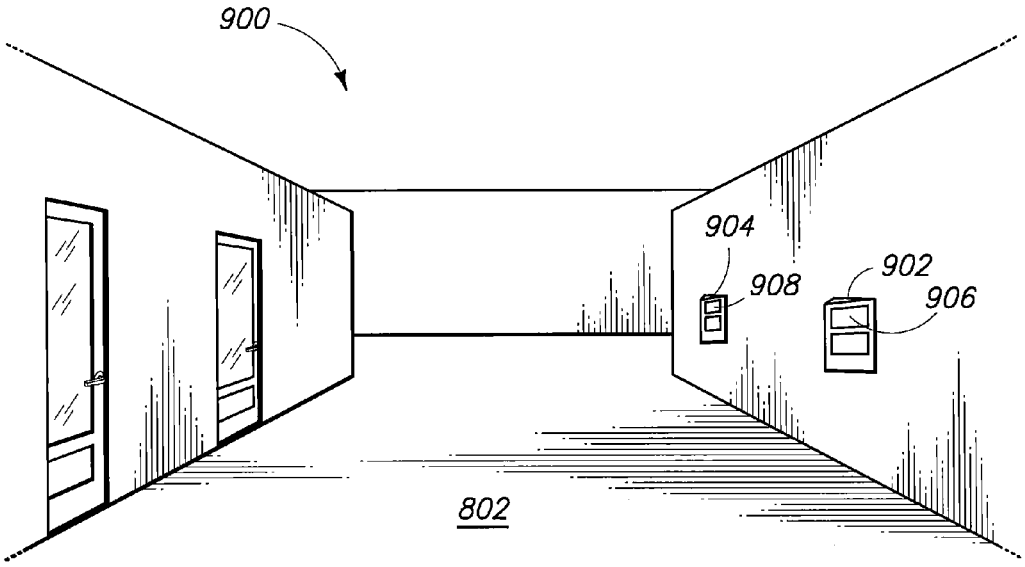
FIG. 9 is an illustration of a second view of a hallway in accordance with an embodiment.
Figure 11:
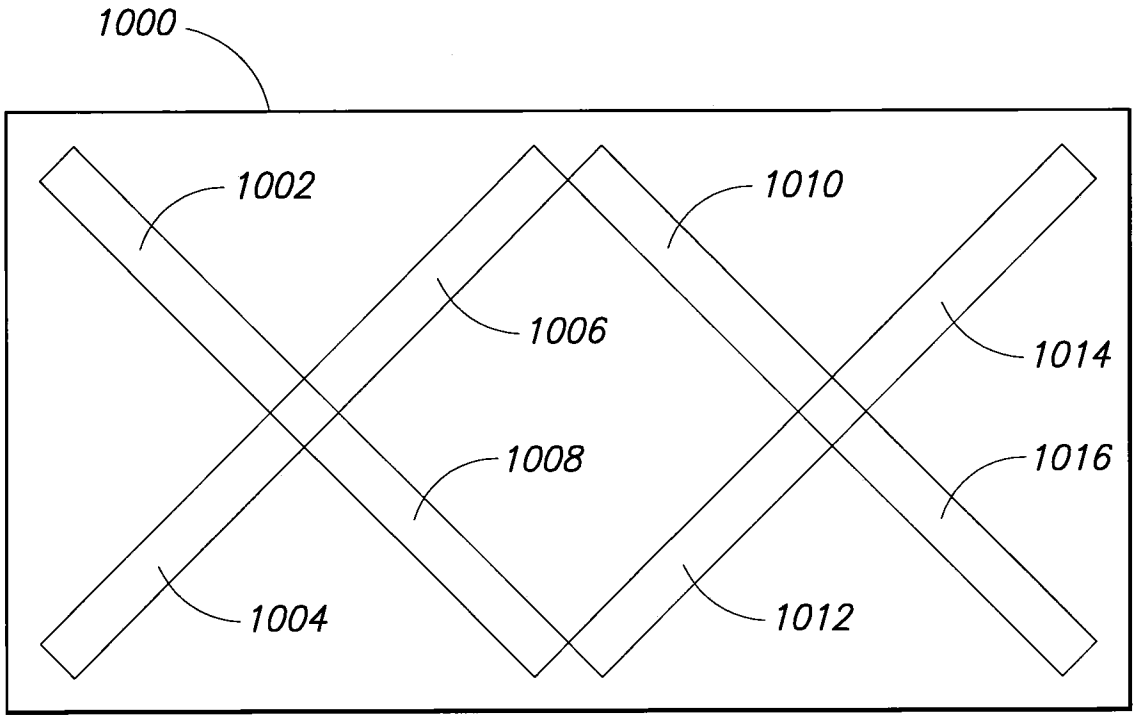

Referring to FIG. 9, a three-dimensional representation 900 of a second view of building hallway 802 from the location is illustrated. The second view is opposite in direction from the first view. In other words, the first view may represent a view looking right down hallway 802 from the location and the second view may represent a view looking left down hallway 802 from the location. Note that from the location, one face of a triangular electronic guide 902, similar to electronic guide 100, is visible. Indicator 906 is located on the face and may be an activated red indicator. Note that from the location, the other two sides of electronic guide 902 are not visible since one faces the hallway wall and the other faces down hall 802 away from the location. Triangular electronic guide 904 is also visible, as is indicator 908, which may also be an activated red indicator.

Accordingly, a person taking in the second view of hallway 802 may be discouraged from traveling down hallway 802 toward electronic guide 902 since red indicators are visible in the second view.

In one embodiment, electronic guides 804, 806, 902, and 904 may be placed on the hallway wall to be close to the floor to minimize obstruction by smoke in the case of a fire. In another embodiment, electronic guides 804, 806, 902, and 904 may be placed on the hallway wall to be close to the ceiling so that they are visible when the hallway is crowded with people or objects. In yet another embodiment (not illustrated), some electronic guides may be placed on the hallway wall close to the ceiling and other electronic guides may be placed on the hallway close to the floor. In some cases speakers associated with the guides may be positioned on the hallway wall to be at the average height of the heads of people occupying the building.

Figure 10:
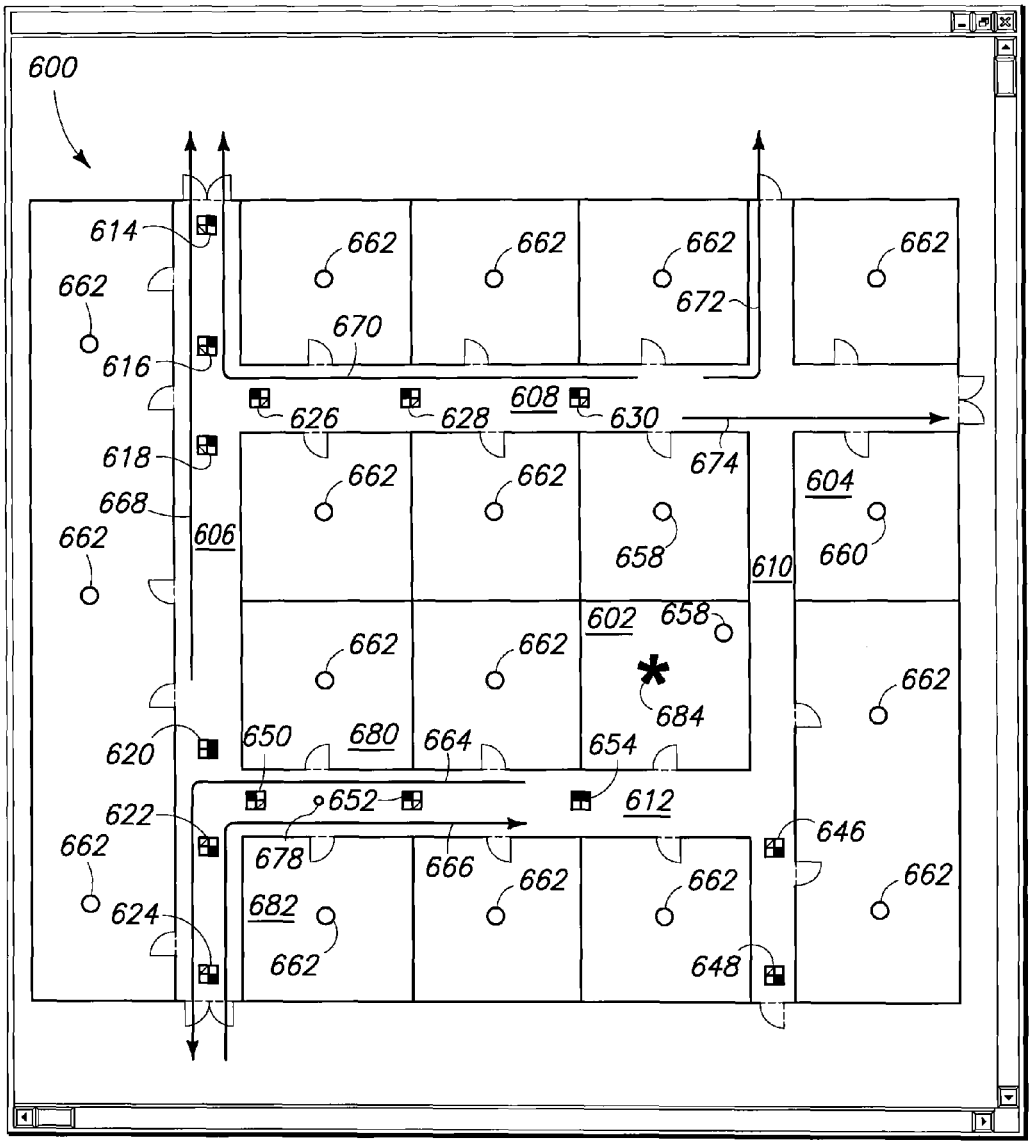
FIG. 10 is an illustration of an electronic guide in accordance with an embodiment.

Referring to FIG. 10, another embodiment of an electronic guide 1000 is illustrated. Guide 1000 may be used in the methods and systems described herein. Guide 1000 includes eight visual indicators 1002, 1004, 1006, 1008, 1010, 1012, 1014, and 1016 whose appearances may be individually configured. The visual indicators may be configured to be one of a set of colors or may be configured to have a neutral or disabled appearance such as a black or white color. For example, in one configuration, indicator 1002 may be green, in another configuration, indicator 1002 may be red, and in another configuration indicator 1002 may be disabled.

The indicators may be embodied in a number of different ways, for example, using light sources (e.g., bulbs or LEDs), colored translucent material (e.g., plastic), or colored material.

In one embodiment, guide 1000 may have a rectangular box-like shape instead of the triangular shape of the guide of FIG. 1. In this embodiment, guide 1000 may be mounted on a wall, floor, or ceiling.

The indicators of guide 1000 may be configured in a number of different ways, each of which may convey different information to a person viewing guide 1000.

In one configuration, all of the indicators of guide 1000 may be disabled indicating that no incident has been detected. For example, if the indicators comprise light sources (e.g., bulbs), the light sources may be disabled.

In another configuration, guide 1000 may direct someone viewing guide 1000 to the right. In this configuration, indicators 1002, 1004, 1010, and 1012 may be green and may collectively form two green arrowheads. The other indicators of guide 1000 may be disabled. Indicators 1002, 1004, 1010, and 1012 may remain statically enabled green. Alternatively, indicators 1002, 1004, 1010, and 1012 collectively may be periodically enabled then disabled to form two green blinking arrowheads.

Alternatively, indicators 1002 and 1004 may be simultaneously enabled green for a short period (e.g., 1 second) and may then be simultaneously disabled. Subsequently, indicators 1010 and 1012 may be simultaneously enabled green for a short period and may then be disabled. This sequence may be repeated, thereby creating a visual effect in which a first green arrowhead pointing right is displayed on the left side of guide 1000 (formed by indicators 1002 and 1004) followed by a second green arrowhead pointing right on the right side of guide 1000 (formed by indicators 1010 and 1012) followed again by the first green arrowhead, and so on.

Alternatively, indicators 1002 and 1004 may be simultaneously enabled green for a first short period (e.g., 1 second) while indicators 1010 and 1012 are disabled and then during a second short period (e.g., 1 second) indicators 1010 and 1012 may be simultaneously enabled green while indicators 1002 and 1004 remain enabled green. The second period may be followed by a third short period (e.g., 1 second) during which all of the indicators of guide 1000 are disabled. This sequence may be repeated, thereby creating a visual effect in which a first green arrowhead is displayed on the left side of guide 1000 (formed by indicators 1002 and 1004) followed by a period in which both the first green arrowhead and a second green arrowhead on the right side of guide 1000 (formed by indicators 1010 and 1012) are displayed.

In another configuration, guide 1000 may direct someone viewing guide 1000 to the left. In this configuration, indicators 1006, 1008, 1014, and 1016 may be green and may collectively form two green arrowheads. The other indicators of guide 1000 may be disabled. Indicators 1006, 1008, 1014, and 1016 may remain statically enabled green. Alternatively, indicators 1006, 1008, 1014, and 1016 collectively may be periodically enabled then disabled to form two green blinking arrowheads.

Alternatively, indicators 1014 and 1016 may be simultaneously enabled green for a short period (e.g., 1 second) and may then be simultaneously disabled. Subsequently, indicators 1006 and 1008 may be simultaneously enabled green for a short period and may then be disabled. This sequence may be repeated, thereby creating a visual effect in which a first green arrowhead pointing left is displayed on the right side of guide 1000 (formed by indicators 1014 and 1016) followed by a second green arrowhead pointing left on the left side of guide 1000 (formed by indicators 1006 and 1008) followed again by the first green arrowhead, and so on.

Alternatively, indicators 1014 and 1016 may be simultaneously enabled green for a first short period (e.g., 1 second) while indicators 1006 and 1008 are disabled and then during a second short period (e.g., 1 second) indicators 1006 and 1008 may be simultaneously enabled green while indicators 1014 and 1016 remain enabled green. The second period may be followed by a third short period (e.g., 1 second) during which all of the indicators of guide 1000 are disabled. This sequence may be repeated, thereby creating a visual effect in which a first green arrowhead is displayed on the right side of guide 1000 (formed by indicators 1014 and 1016) followed by a period in which both the first green arrowhead and a second green arrowhead on the left side of guide 1000 (formed by indicators 1006 and 1008) are displayed.

In another configuration, guide 1000 may mark an exit. In this configuration, all of the indicators of guide 1000 may be enabled green. The indicators may remain statically enabled green or may blink.

In another configuration, guide 1000 may indicate that a person viewing guide 1000 should move away from guide 1000. In this configuration, all of the indicators of guide 1000 may be enabled red. The indicators may remain statically enabled red or may blink. In one embodiment, blinking red indicators may convey the fact that an incident is located near guide 1000.

In another configuration, guide 1000 may indicate that an incident is located near guide 1000. In this configuration, indicators 1002, 1004, 1006, and 1008 may be simultaneously enabled red for a short period (e.g., 1 second) and may then be simultaneously disabled. Subsequently, indicators 1010, 1012, 1014, and 1016 may be simultaneously enabled red for a short period and may then be disabled. This sequence may be repeated, thereby creating a visual effect in which a first red "x" is displayed on the left side of guide 1000 (formed by indicators 1002, 1004, 1006, and 1008) followed by a second red "x" on the right side of guide 1000 (formed by indicators 1010, 1012, 1014, and 1016) followed again by the first red "x", and so on. Alternatively, this configuration may be used to indicate that a switch of guide 1000 (e.g, a switch like switch 122 described above) has been manually activated.

In another configuration, guide 1000 may indicate that a switch of guide 1000 has been manually activated. In this configuration, indicators 1002, 1004, 1006, and 1008 may be simultaneously enabled green for a short period (e.g., 1 second) and may then be simultaneously disabled. Subsequently, indicators 1010, 1012, 1014, and 1016 may be simultaneously enabled red for a short period and may then be disabled. This sequence may be repeated, thereby creating a visual effect in which a green "x" is displayed on the left side of guide 1000 (formed by indicators 1002, 1004, 1006, and 1008) followed by a red "x" on the right side of guide 1000 (formed by indicators 1010, 1012, 1014, and 1016) followed again by the green "x", and so on. Alternatively, the "x" on the left may be red and the "x" on the right may be green.

According to another aspect of the invention, an article of manufacture includes media including programming configured to cause processing circuitry (e.g., a microprocessor) to perform processing that executes one or more of the methods described above. The programming may be embodied in a computer program product(s) or article(s) of manufacture, which can contain, store, or maintain programming, data, and/or digital information for use by or in connection with an instruction execution system including processing circuitry. In some cases, the programming may be referred to as software, hardware, or firmware.

For example, the media may be electronic, magnetic, optical, electromagnetic, infrared, or semiconductor media. Some more specific examples of articles of manufacture including media with programming include, but are not limited to, a portable magnetic computer diskette (such as a floppy diskette or a ZIP® disk manufactured by the Iomega Corporation of San Diego, Calif.), hard drive, random access memory, read only memory, flash memory, cache memory, and/or other configurations capable of storing programming, data, or other digital information.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. An incident response method comprising:

receiving notification that an incident has occurred;

determining a source of the notification, the source being near the incident;

establishing at least one guided path configured to direct a first person, a first animal, or a first movable device positioned near the source away from the incident and/or to direct a second person, a second animal, or a second movable device toward the incident; and after the receiving of the notification and prior to the establishing of the at least one guided path, receiving information describing at least a portion of the at least one guided path from a user and wherein the establishing of the at least one guided path comprises establishing the at least one guided path using the information.

2. The method of claim 1 wherein the establishing of the at least one guided path comprises configuring a plurality of electronic guides, the electronic guides of the plurality being positioned near the incident and in different locations relative to one another.

3. The method of claim 2 further comprising:

after the configuring of the plurality of electronic guides, activating a first signal at a first electronic guide of the plurality;

after the activating of the first signal, activating a second signal at a second electronic guide of the plurality;

after the activating of the second signal, activating a third signal at a third electronic guide of the plurality; and wherein the first, second, and third electronic guides of the plurality are positioned at different locations along the guided path relative to one another, the second electronic guide of the plurality being spaced a first distance along the guided path from the first electronic guide of the plurality and the third electronic guide of the plurality being spaced a second distance along the guided path from the first electronic guide of the plurality wherein the second distance is greater than the first distance.

4. The method of claim 3 wherein the first, second, and third signals are audible signals detectable by the first animal, second animal, first moveable device, and/or second moveable device.

5. The method of claim 1 wherein the location is within a venue, the first person is within the venue, and the establishing of the at least one guided path comprises establishing the least one guided path so that the at least one guided path leads the first person out of the venue, and wherein at the time of the establishing of the at least one guided path, a first exit of the venue is nearer the first person than a second exit of the venue, the source is nearer the first exit than the second exit, and the establishing of the at least one guided path comprises establishing at least one guided path to direct the first person to the second exit.

6. The method of claim 1 wherein the notification comprises a first notification, the incident comprises a first incident, the source comprises a first source, and further comprising:

after the receiving of the first notification, receiving a second notification that a second incident has occurred which is remote from the first incident;

determining a second source of the second notification, the second source being positioned near the second incident; and re-configuring at least a portion of the at least one guided path so that the at least one guided path leads the first person away from the first incident and away from the second incident.

7. The method of claim 1 further comprising:

receiving initial information describing a plurality of predetermined paths from a user prior to the receiving of the notification; and based on the determining of the source of the notification, automatically and without user intervention, selecting the at least one guided path using the initial information.

8. The method of claim 1 wherein the location is within a venue and further comprising after the receiving of the notification, automatically and without user intervention, locking or unlocking one or more doors of the venue.

9. An incident response system comprising:

a plurality of electronic guides positioned within pathways of a building in different locations relative to one another;

management circuitry configured to:

receive notification that an incident has occurred within the building;

determine a source of the notification, the source being positioned in a location near the incident; and establish a directional path through the pathways leading away from the location toward an exit of the building by sequentially enabling the electronic guides of the plurality that are positioned along the directional path to emit a plurality of human perceptible signals in a sequence; and wherein the electronic guides comprise audible guides which are configured to emit the human perceptible signals comprising audible signals.

10. The system of claim 9 wherein the establishing the directional path includes enabling a first of the electronic guides to emit a respective one of the human perceptible signals in the sequence before enabling a second of the electrical guides to emit a respective one of the human perceptible signals, and wherein the first electronic guide is positioned closer to the location than the second electronic guide and the second electronic guide is positioned closer to the exit than the first electronic guide.

11. The system of claim 9 wherein the electronic guides comprise visible guides which are configured to emit the human perceptible signals comprising visible signals.

12. The system of claim 9 further comprising a plurality of visible electronic guides configured to emit visible signals, and wherein the audible guides are positioned along the directional path at locations which are intermediate the visible electronic guides.

13. An incident monitoring method comprising:

receiving a notification that an incident has occurred;

using circuitry, and in response to the receiving of the notification, requesting status information from a plurality of electronic guides configured to establish at least one guided path configured to direct a person positioned near the incident away from the incident;

using circuitry, receiving the status information from at least some of the electronic guides of the plurality; and providing the status information.

14. The method of claim 13 wherein the status information comprises environmental data collected by the electronic guides and further comprising time stamping the data and storing the data.

15. The method of claim 13 wherein the providing the status information comprises displaying the status information on a map, the map illustrating positions of the electronic guides of the plurality relative to one another.

16. The method of claim 15 wherein the electronic guides of the plurality are located in a building and the map comprises at least one floor plan of the building.

17. The method of claim 16 further comprising representing electronic guides of the plurality from which the status information has not been received on the floor plan.

18. The method of claim 16 wherein at least some of the electronic guides of the plurality comprise switches configured to be activated by a person positioned adjacent to the at least some of the electronic guides of the plurality and further comprising indicating on the floor plan which switches have been activated.

19. The method of claim 16 further comprising receiving status information related to detectors of a detector system and representing the status information on the floor plan, the detectors being configured to monitor one or more environmental parameters.

20. A management system comprising:

circuitry configured to:

receive a notification that an incident has occurred;

as a result of the receiving of the notification, request status information from a plurality of electronic guides which are configured to establish at least one guided path configured to direct a person positioned near an incident away from the incident;

receive the status information from at least some of the electronic guides of the plurality; and provide the status information.

21. The system of claim 20 wherein the status information comprises environmental data collected by the electronic guides, and wherein at least one of the electronic guides and the circuitry are configured to time stamp the environmental data and to store the environmental data.

22. The system of claim 20 wherein the circuitry is configured to display the status information on a map to provide the status information, and wherein the map illustrates positions of the electronic guides of the plurality relative to one another.

23. The system of claim 22 wherein the electronic guides of the plurality are located in a building and the map comprises at least one floor plan of the building.

24. The system of claim 23 wherein the map represents at least one of the electronic guides of the plurality from which the status information has not been received on the floor plan.

25. The system of claim 23 wherein at least some of the electronic guides of the plurality comprise switches which are configured to be activated by a person positioned adjacent to the at least some of the electronic guides of the plurality, and wherein the floor plan indicates which switches have been activated.

26. The system of claim 23 wherein the circuitry is configured to receive status information related to a plurality of detectors which are individually configured to monitor one or more environmental parameters and to represent the status information related to the detectors on the floor plan.

27. An incident response method comprising:

receiving notification that an incident has occurred within a building;

determining a source of the notification, the source being positioned in a location near the incident;

establishing a directional path through pathways of the building leading away from the location toward an exit of the building by sequentially enabling a plurality of electronic guides positioned within the pathways of the building in different locations relative to one another along the directional path to emit a plurality of human perceptible signals in a sequence; and wherein the emitting the plurality of human perceptible signals comprises emitting audible signals in the sequence.

* * * * *